US006746015B2

(12) United States Patent
Lehmann

(10) Patent No.: US 6,746,015 B2
(45) Date of Patent: Jun. 8, 2004

(54) TRANSPORT DEVICE FOR FLAT GOODS, ESPECIALLY PAPER

(75) Inventor: Jürgen Lehmann, Schönwald (DE)

(73) Assignee: Mathias Bäuerle GmbH, St. Georgen (DE)

( * ) Notice: Subject to any disclaimer, the term of this patent is extended or adjusted under 35 U.S.C. 154(b) by 163 days.

(21) Appl. No.: 10/143,448

(22) Filed: May 9, 2002

(65) Prior Publication Data

US 2002/0171196 A1 Nov. 21, 2002

(30) Foreign Application Priority Data

May 10, 2001 (DE) ..... 101 22 716

(51) Int. Cl.[7] ..... B65H 5/02
(52) U.S. Cl. ..... 271/276; 271/197
(58) Field of Search ..... 271/196, 197, 271/276

(56) References Cited

U.S. PATENT DOCUMENTS 4,555,013 A * 11/1985 Franklin ..... 198/689.1
5,664,773 A * 9/1997 Sevcik et al. ..... 271/276
5,938,193 A * 8/1999 Bluemle et al. ..... 271/243
5,967,510 A * 10/1999 Ono et al. ..... 271/196
6,394,596 B1 * 5/2002 Wotton et al. ..... 347/104
6,575,459 B1 * 6/2003 Kakiwaki et al. ..... 271/242
6,582,072 B1 * 6/2003 Wotton et al. ..... 347/104

* cited by examiner

*Primary Examiner*—David H. Bollinger
(74) *Attorney, Agent, or Firm*—Gudrun E. Huckett

(57) ABSTRACT

A transport device for transporting flat goods has at least one transport belt having longitudinal edges and a transport area. At least one vacuum device and at least one guide with sidewalls are provided. The transport area of the at least one transport belt is arranged in the at least one guide such that at least one vacuum slot is formed between at least one of the longitudinal edges of the transport belt and one of the sidewalls neighboring the at least one longitudinal edge. The at least one transport belt has a profiling configured such that vacuum acts on the flat goods via the profiling.

19 Claims, 2 Drawing Sheets

TRANSPORT DEVICE FOR FLAT GOODS, ESPECIALLY PAPER

BACKGROUND OF THE INVENTION

1. Field of the Invention

The invention relates to a transport device for flat goods, especially paper. The transport device comprises at least one transport belt and at least one suction or vacuum device.

2. Description of the Related Art

Transport devices are known in which the transport belt is formed as a vacuum belt having a plurality of holes via which the vacuum can act onto the goods to be transported. In this way, the goods to be transported are pulled by vacuum against the transport belt and are reliably transported thereon. Such transport belts are relatively complex and expensive because the holes must be formed within the transport belt in an additional manufacturing step.

SUMMARY OF THE INVENTION

It is an object of the present invention to configure a transport device of the aforementioned kind such that the transport belt can be manufactured simply and cost-efficiently but still has a long service life and ensures a flawless passage of air.

In accordance with the present invention, this is achieved in that the transport belt in the transport area is arranged in at least one guide such that at least one vacuum slot is formed between at least one longitudinal edge of the transport belt and a neighboring sidewall of the guide.

As a result of the configuration according to the invention, the transport belt no longer must be provided with openings or the like. The vacuum generated by the vacuum or suction device can act by means of the vacuum slot onto the goods to be transported. In this way, these goods to be transported can be held and transported reliably on the transport belt.

As a result of the configuration according to the invention, it is no longer necessary to perform additional processing steps or manufacturing steps on the transport belt. The transport device according to the invention can be employed for folding machines, inserting machines or the like in paper or printed product processing.

DESCRIPTION OF THE PREFERRED EMBODIMENTS

Figure 1:
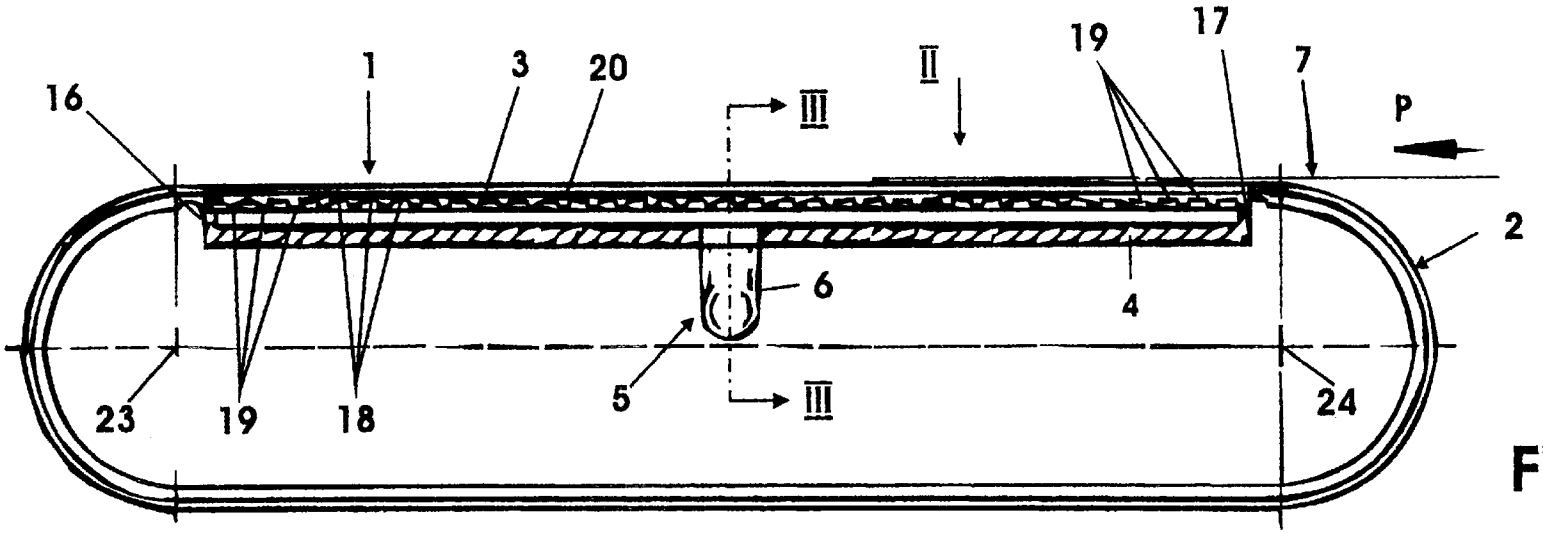
FIG. 1 is a longitudinal section view of the transport device according to the invention.

The transport device 1 illustrated in the drawings is employed for transporting flat goods 7, preferably paper, wherein the goods to be transported are held by vacuum on the endless transport belt 2 of the transport device 1. The transport belt 2 is guided about two driven deflection pulleys. FIG. 1 only shows the axes of rotation 23, 24 of the deflection pulleys. The transport belt 2 is advantageously formed as a toothed belt.

Figure 2:
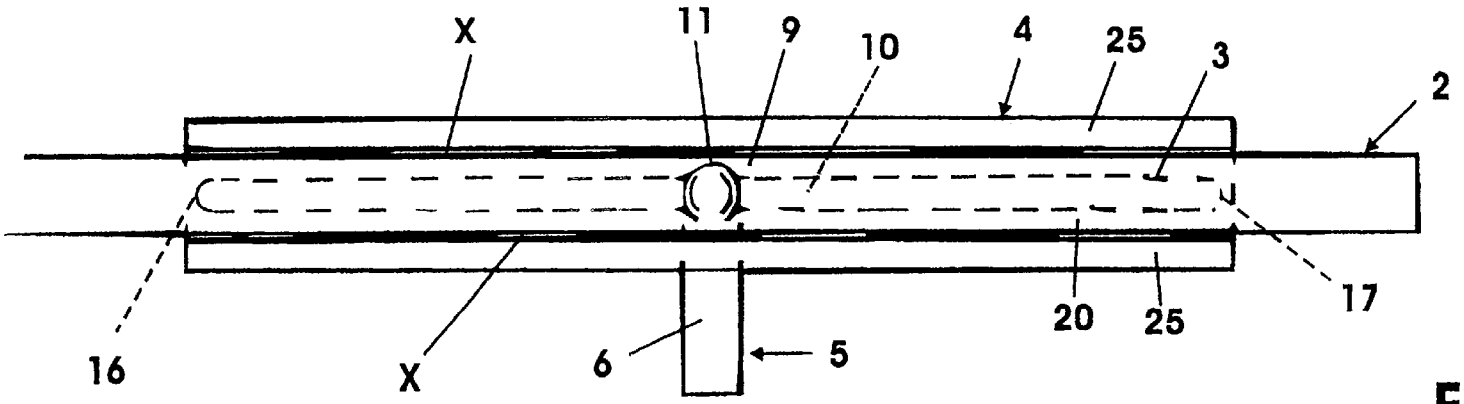
FIG. 2 shows the transport device according to FIG. 1 in a plan view according to arrow 11 of FIG. 1.
Figure 3:
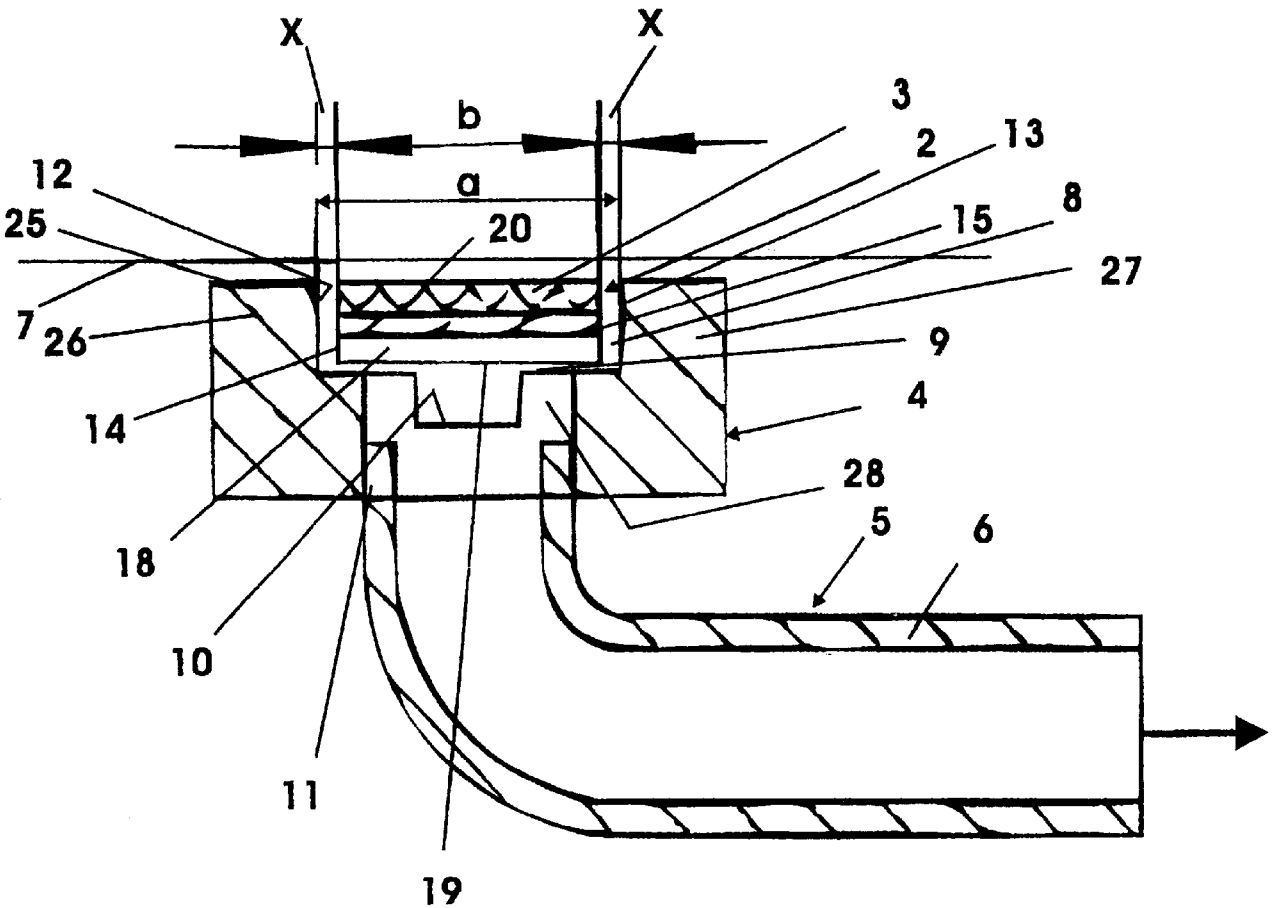
FIG. 3 shows a section view along the section line III—III of FIG. 1 in enlarged illustration.

On the carrying run 3 of the transport belt 2 the flat goods in the form of paper 7 are positioned and secured by the vacuum effect. The carrying run 3 is positioned in a guide 4 of a vacuum device 5 which is illustrated only partially. It is connected by a vacuum channel 6 to a vacuum pump (not illustrated). The guide 4 is a profiled rail and has a recess 8 which is a receptacle for the carrying run 3 and extends across the entire length of the guide 4. The top side or support side 20 of the carrying run 3 is flush with the top side 25 of sidewalls 26, 27 of the guide 4 which delimit the recess 8 in the longitudinal direction. The bottom 9 of the recess 8 has a groove 10 which extends substantially across the entire length of the bottom 9 and is closed at its ends (FIG. 2). The ends of the groove 10 are closed by a transverse wall 16, 17 (FIGS. 1 and 2), respectively. The angled end 11 of a vacuum channel 6 opens into the groove 10 at approximately half the length of the groove 10. The end 11 of the suction channel 6 is connected preferably by pressfit to the opening 28 that opens into the groove 10. The air can be reliably sucked away from the area of the recess 8 over its entire length via the groove 10. The carrying run 3 is narrower than the recess 8 and thus has play (x) relative to the recess 8. As a result of the narrower width (play) of the carrying run 3 in comparison to the width of the recess 8, a narrow slot x is formed between the longitudinal edges 14, 15 of the carrying run 3 and the inner side 12, 13 of the sidewall 26, 27, respectively. It extends across the entire length of the guide 4. In the illustrated embodiment, the two slots x are of the same width. However, the slots x can have different widths. It is moreover possible that the carrying run 3 is arranged relative to the recess 8 such that a slot x is provided only on one longitudinal side of the carrying run 3.

The transport belt 2 is mounted such that its teeth 18, extending transverse to the longitudinal direction, are oriented inwardly so that the top side or support side 20 facing the transported goods 7 is plane. The recesses 19 (FIG. 1) between the teeth 18 form transverse channels which open into the slot(s) x. In this way, the vacuum can act via the vacuum channel 6, the groove 10, the recess 8, the transverse channels 19 and the slot(s) x onto the transported goods 7, e.g., paper.

In this way, the transported goods 7 are pulled perfectly against the support side 20 of the transport belt 2 so that they are entrained reliably on the belt 2 in the transport direction P. Since the transported goods 7 also rests on the end faces 25 of the sidewalls 26, 27 of the guide 4, the friction between the transported goods 7 and the support side 20 of the transport belt 2 must be greater than that between the end faces 25 of the guide 4 and the transported goods 7. Accordingly, the support side 20 of the transport belt 2 is formed such that it has a relatively high coefficient of friction in comparison to the end faces 25. Advantageously, the support side 20 of the transport belt 2 can be formed by a corresponding coating with a high coefficient of friction.

By embodying the transport belt 2 as a toothed belt, the transport belt 2 is very well suited for the start and stop operation of the transport device 1. The transport belt 2 has a long service life and ensures moreover a secure holding and transport of the transported goods so that they are not damaged and are entrained properly.

The guide 4 is at most of the same width as the transported goods 7 and preferably narrower than the transported goods. When the transported goods 7 are very wide, it is also possible to arrange two or more such transport devices adjacent to one another. However, it is also possible to configure the recess 8 of the guide 4 of such a width that two or more transport belts 2 are positioned adjacent to one another. Of course, it is also possible to employ in the case of wide goods 7 to be transported a correspondingly wide transport belt 2.

The transport belt 2 can have profilings other than teeth 18; these profilings are designed such that the vacuum produced by the vacuum pump can act on the transported goods 7.

In a simple configuration the transport belt 2 has no profilings. In this case, the lateral slot or slots x are sufficient to deliver the vacuum to the transported goods 7. In such an embodiment, a conventional and thus inexpensive transport belt in the form of a flat belt can be used. Advantageously, in such situations the groove 10 is positioned such that it is underneath the slot area, respectively.

While specific embodiments of the invention have been shown and described in detail to illustrate the inventive principles, it will be understood that the invention may be embodied otherwise without departing from such principles.

What is claimed is:

1. A transport device for transporting flat goods, the transport device comprising:

at least one transport belt having longitudinal edges and a transport area;

at least one vacuum device;

at least one guide having sidewalls;

wherein the transport area of the at least one transport belt is arranged in the at least one guide such that at least one vacuum slot is formed between at least one of the longitudinal edges of the transport belt and that one of the sidewalls neighboring the at least one longitudinal edge.

2. The transport device according to claim 1, wherein the at least one vacuum slot extends across an entire length of the guide.

3. The transport device according to claim 1, wherein two of the at least one vacuum slots are provided, wherein a first one of the two vacuum slots is provided on a first one of the longitudinal edges and a second one of the two vacuum slots is provided on a second one of the longitudinal edges.

4. The transport device according to claim 1, wherein the at least one transport belt has a profiling configured such that vacuum acts on the flat goods via the profiling.

5. The transport device according to claim 4, wherein the profiling comprises projections and depressions, the projections and depressions extending transverse to a longitudinal direction of the transport belt.

6. The transport device according to claim 5, wherein the depressions open into the at least one vacuum slot.

7. The transport device according to claim 4, wherein the profiling is provided across an entire length of the at least one transport belt.

8. The transport device according to claim 4, wherein the at least one transport belt is a toothed belt.

9. The transport device according to claim 1, wherein the at least one transport belt is positioned in the at least one guide with lateral play forming the at least one vacuum slot.

10. The transport device according to claim 9, wherein the at least one guide has a recess configured to receive a part of the at least one transport belt.

11. The transport device according to claim 10, wherein a width of the at least one transport belt is smaller than an inner width of the recess of the at least one guide.

12. The transport device according to claim 10, wherein the lateral play of the at least one transport belt is such that two of the at least one lateral vacuum slots are formed.

13. The transport device according to claim 10, wherein the recess has a bottom and wherein the at least one guide has a groove in the area of the bottom of the recess.

14. The transport device according to claim 13, wherein the groove extends across an entire length of the bottom of the recess.

15. The transport device according to claim 13, comprising at least one vacuum channel opening into the groove.

16. The transport device according to claim 15, wherein the at least one vacuum channel is a tube.

17. The transport device according to claim 1, wherein the at least one transport belt has a support side for the flat goods and wherein the support side has a higher coefficient of friction than a support surface of the at least one guide.

18. The transport device according to claim 17, wherein the support side is provided at least partially with a coating having a high coefficient of friction.

19. The transport device according to claim 17, wherein the at least one transport belt has a profiling configured such that vacuum acts on the flat goods via the profiling, wherein the profiling is provided on a side of the at least one transport belt facing away from a support side of the at least one transport belt on which the flat goods are transported.

* * * * *